US011535342B2

(12) United States Patent
Lombino

(10) Patent No.: US 11,535,342 B2
(45) Date of Patent: Dec. 27, 2022

(54) INFLATABLE PADDLEBOARD WITH EXTERIOR STRINGER SYSTEM

(71) Applicant: Sol Paddle Boards, Inc, Telluride, CO (US)

(72) Inventor: Christopher John Lombino, Telluride, CO (US)

(73) Assignee: SOL Paddle Boards, Inc, Telluride, CO (US)

( * ) Notice: Subject to any disclaimer, the term of this patent is extended or adjusted under 35 U.S.C. 154(b) by 109 days.

(21) Appl. No.: 17/240,213

(22) Filed: Apr. 26, 2021

(65) Prior Publication Data

US 2021/0371055 A1 Dec. 2, 2021

Related U.S. Application Data

(60) Provisional application No. 63/031,322, filed on May 28, 2020.

(51) Int. Cl.

| | |
|---|---|
| ***B63B 32/22*** | (2020.01) |
| ***B63B 5/24*** | (2006.01) |
| ***B63B 7/08*** | (2020.01) |

(52) U.S. Cl.

CPC ..... *B63B 32/22* (2020.02); *B63B 5/24* (2013.01); *B63B 7/085* (2013.01)

(58) Field of Classification Search

CPC ..... B63B 32/22; B63B 5/24; B63B 7/085

See application file for complete search history.

(56) References Cited

U.S. PATENT DOCUMENTS

| | | | | |
|---|---|---|---|---|
| 4,798,549 | A * | 1/1989 | Hirsch | B63B 32/40 441/74 |
| 5,129,344 | A | 7/1992 | Ono | |
| 5,356,324 | A | 10/1994 | Cunningham | |
| 7,985,111 | B2 | 7/2011 | Gasparro | |
| 8,591,274 | B2 * | 11/2013 | Haller | B63B 32/51 114/345 |
| 9,616,977 | B2 * | 4/2017 | Kim | B63B 32/51 |
| 10,046,836 | B2 * | 8/2018 | Hall | B63B 32/64 |
| 10,086,918 | B2 * | 10/2018 | Pepper | B63B 32/51 |
| 11,305,845 | B2 * | 4/2022 | Hawthorne | B63B 32/51 |
| 2013/0102212 | A1 * | 4/2013 | Rainey | B63B 32/51 29/527.1 |
| 2017/0197691 | A1 * | 7/2017 | Pepper | B63B 32/59 |
| 2021/0371055 | A1 * | 12/2021 | Lombino | B63B 32/22 |

FOREIGN PATENT DOCUMENTS

WO WO 2013/175160 11/2013

* cited by examiner

*Primary Examiner* — S. Joseph Morano
*Assistant Examiner* — Jovon E Hayes
(74) *Attorney, Agent, or Firm* — Critical Path IP Law, LLC

(57) ABSTRACT

Systems and methods to provide an exterior stringer system inflatable paddleboard. The exterior stringer system inflatable paddleboard maintains the benefits of a baseline inflatable paddleboard while providing increased strength, such as increased rigidity or stiffness. The exterior stringer system is positioned on the bottom surface of a baseline inflatable paddleboard. In one embodiment, the exterior stringer system is formed by a set of longitudinal stringers positioned on opposite sides of an inflatable paddleboard and a set of transverse stringers arranged in an X configuration between the longitudinal stringers.

20 Claims, 10 Drawing Sheets

499

| Design | 492 (mm) | 493 (mm) | 494 (mm) | 495 (mm) | 498 (mm) | 497 (deg) |
|---|---|---|---|---|---|---|
| SOL Train | 1700 | 1138 | 348 | 50 | 1346 | 41 |
| SOL Sumo | 1650 | 1278 | 353 | 50 | 1482 | 37 |
| SOL Shine | 1800 | 1268 | 399 | 50 | 1470 | 41 |
| SOL Ocho | 1150 | 832 | 400 | 50 | 1022 | 61 |
| SOL Shiva | 1650 | 1379 | 466 | 50 | 1485 | 50 |
| SOL Sonic | 1899 | 1249 | 250 | 50 | 1472 | 29 |

FIG.4E

INFLATABLE PADDLEBOARD WITH EXTERIOR STRINGER SYSTEM

CROSS-REFERENCE TO RELATED APPLICATIONS

This application is a nonprovisional patent application of and claims the benefit of U.S. Provisional Patent Application No. 63/031,322 titled "Inflatable Paddleboard with Exterior Stringer System" and filed May 28, 2020, the disclosure of which is hereby incorporated herein by reference in entirety.

FIELD

The disclosure relates generally to an inflatable paddleboard with exterior stringer system, and specifically to an inflatable paddleboard with an exterior stringer system positioned on the bottom surface of an inflatable paddleboard.

BACKGROUND

Paddleboards are in wide spread recreational use in many water environments for a variety of purposes, spanning ocean and river use for exercise to serving as a yoga platform. Paddleboards are of a rigid type and an inflatable type and are commonly referred to as stand up paddleboards. Inflatable paddleboards strive to provide similar paddleboard characteristics to a rigid paddleboard yet allow much easier transport and storage. However, conventional inflatable paddleboards tend to present undesirable structural characteristics, such as limited structural stiffness resulting in flexing of the paddleboard, particularly in the middle portion of the inflatable paddleboard.

What is needed is an inflatable paddleboard with an exterior stringer system that strengthens a baseline or conventional inflatable paddleboard. This disclosure solves these needs. The disclosed paddleboard provides a paddleboard with structural characteristics approaching if not matching those of a rigid paddleboard yet provides the transportation and storage benefits of an inflatable paddleboard. The inflatable paddleboard with exterior stringer system may be fitted with a combined carry and roll strap.

SUMMARY

An inflatable paddleboard with exterior stringer system is disclosed. The exterior stringer system maintains the benefits of an inflatable paddleboard while providing increased strength, such as increased rigidity or stiffness.

In one aspect, the exterior stringer system is positioned on the bottom surface of an inflatable paddleboard. In one embodiment, the exterior stringer system is formed by a set of longitudinal stringers positioned on opposite sides of the inflatable paddleboard and a set of transverse stringers arranged in an X configuration between the longitudinal stringers.

In one embodiment, an exterior stringer system paddleboard is disclosed comprising: an inflatable paddleboard comprising a body, a front, a back, a top surface, a bottom surface with a bottom surface left side and a bottom surface right side, and a longitudinal axis extending between the front and the back; and an exterior stringer system disposed on the bottom surface, the exterior stringer system comprising a set of longitudinal stringers and a set of transverse stringers; wherein: the set of longitudinal stringers are positioned generally parallel to the longitudinal axis and define a bottom surface void therebetween; and the set of transverse stringers are positioned at least partially within the bottom surface void and at one or more angles from the longitudinal axis.

In one aspect, the set of transverse stringers form a symmetrical X shape between at least two longitudinal stringers of the set of longitudinal stringers, the at least two longitudinal stringers positioned adjacent each of the bottom surface left side and the bottom surface right side. In another aspect, the set of longitudinal stringers are at least two longitudinal stringers comprising a first longitudinal stringer and a second longitudinal stringer; the set of transverse stringers are at least two transverse stringers comprising a first transverse stringer and a second transverse stringer; the first transverse stringer extends from the first longitudinal stringer to the second longitudinal stringer; and the second transverse stringer extends from the second longitudinal stringer to the first longitudinal stringer. In another aspect, the first transverse stringer intersects with the second transverse stringer to form a transverse stringer intersection. In another aspect, the transverse stringer intersection is positioned along the longitudinal axis. In another aspect, the at least two transverse stringers and the at least two longitudinal stringers define a symmetrical shape about the longitudinal axis. In another aspect, the exterior stringer system provides an increased strength of the inflatable paddleboard along the longitudinal axis. In another aspect, the exterior stringer system provides an increased strength of the inflatable paddleboard along a lateral axis of the inflatable paddleboard, the lateral axis perpendicular to the longitudinal axis. In another aspect, a length of each of the at least two longitudinal stringers is at least 60% of an inflatable paddleboard length defined as a distance between the front and the back. In another aspect, the at least two longitudinal stringers and the at least two transverse stringers are made of a PVC material. In another aspect, the PVC material comprises carbon.

In another embodiment, an exterior stringer system paddleboard is disclosed comprising: an inflatable paddleboard comprising a body, a front, a back, a top surface, a bottom surface with a bottom surface left side and a bottom surface right side, and a longitudinal axis extending between the front and the back; and an exterior stringer system disposed on the bottom surface, the exterior stringer system comprising two longitudinal stringers and at least two transverse stringers; wherein: the two longitudinal stringers are positioned generally parallel to the longitudinal axis and define a bottom surface void therebetween; and the at least two transverse stringers are positioned between the bottom surface void and at an acute angle with respect to the longitudinal axis, each of the at least two transverse stringers forming a connection with each of the two longitudinal stringers; wherein: the exterior stringer system increases the stiffness of the inflatable paddleboard.

In one aspect, the two longitudinal stringers and the at least two transverse stringers comprise a PVC material; a length of each of the at two longitudinal stringers is at least 60% of an inflatable paddleboard length defined as a distance between the front and the back; and a first transverse stringer intersects with a second transverse stringer to form a transverse stringer intersection, the transverse stringer intersection positioned along the longitudinal axis.

In yet another embodiment, a method of assembling an exterior stringer system paddleboard is disclosed, the method comprising: providing an inflatable paddleboard comprising a body, a front, a back, a top surface, a bottom surface with a bottom surface left side and a bottom surface right side, and a longitudinal axis extending between the front and the back; providing a set of longitudinal stringers and a set of transverse stringers; attaching the set of longitudinal stringers to the bottom surface, the set of longitudinal stringers positioned generally parallel to the longitudinal axis and defining a bottom surface void therebetween; and attaching the set of transverse stringers to the bottom surface at least partially within the bottom surface void, the set of transverse stringers positioned at one or more angles from the longitudinal axis; wherein: an exterior stringer system paddleboard is assembled.

In one aspect, each of the set of longitudinal stringers and the set of transverse stringers are attached to the bottom surface using an adhesive. In another aspect, the set of transverse stringers form a symmetrical X shape between at least two longitudinal stringers of the set of longitudinal stringers, the at least two longitudinal stringers positioned adjacent each of the bottom surface left side and the bottom surface right side. In another aspect, the set of longitudinal stringers are at least two longitudinal stringers comprising a first longitudinal stringer and a second longitudinal stringer; the set of transverse stringers are at least two transverse stringers comprising a first transverse stringer and a second transverse stringer; the first transverse stringer extends from the first longitudinal stringer to the second longitudinal stringer; and the second transverse stringer extends from the second longitudinal stringer to the first longitudinal stringer. In another aspect, the first transverse stringer intersects with the second transverse stringer to form a transverse stringer intersection positioned along the longitudinal axis. In another aspect, the exterior stringer system provides an increased strength of the inflatable paddleboard along the longitudinal axis. In another aspect, a length of each of the at least two longitudinal stringers is at least 60% of an inflatable paddleboard length defined as a distance between the front and the back.

In order to comply with the disclosure requirements of 35 USC Section 112, the following references are imported by reference for all purposes: U.S. Pat. No. 10,086,918 to Pepper; U.S. Pat. No. 9,616,977 to Kim; U.S. Pat. No. 7,985,111 to Gasparro; U.S. Pat. No. 10,046,836 to Hall; and U.S. Pat. No. 8,591,274 to Haller; US Pat. Appl. Nos. 2014/20140364022 to Dingel and 2013/0102212 to Rainey; and WIPO Pat. Appl. No. 2013/175160 to Tushingham.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

The terms "determine", "calculate" and "compute," and variations thereof, as used herein, are used interchangeably and include any type of methodology, process, mathematical operation or technique.

The term "means" as used herein shall be given its broadest possible interpretation in accordance with 35 U.S.C., Section 112, Paragraph 6. Accordingly, a claim incorporating the term "means" shall cover all structures, materials, or acts set forth herein, and all of the equivalents thereof. Further, the structures, materials or acts and the equivalents thereof shall include all those described in the summary, brief description of the drawings, detailed description, abstract, and claims themselves.

The preceding is a simplified summary of the disclosure to provide an understanding of some aspects of the disclosure. This summary is neither an extensive nor exhaustive overview of the disclosure and its various aspects, embodiments, and/or configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and/or configurations of the disclosure are possible utilizing, alone or in combination, one or more of the features set forth above or described in detail below. Also, while the disclosure is presented in terms of exemplary embodiments, it should be appreciated that individual aspects of the disclosure can be separately claimed.

BRIEF DESCRIPTION OF THE DRAWINGS

The disclosure will be readily understood by the following detailed description in conjunction with the accompanying drawings, wherein like reference numerals designate like elements. The elements of the drawings are not necessarily to scale relative to each other. Identical reference numerals have been used, where possible, to designate identical features that are common to the figures.

FIG. 4E is a table of designs of the geometries of the exterior stringer system of FIG. 4D;

It should be understood that the proportions and dimensions (either relative or absolute) of the various features and elements (and collections and groupings thereof) and the boundaries, separations, and positional relationships presented there between, are provided in the accompanying figures merely to facilitate an understanding of the various embodiments described herein and, accordingly, may not necessarily be presented or illustrated to scale (unless indicated), and are not intended to indicate any preference or requirement for an illustrated embodiment to the exclusion of embodiments described with reference thereto. FIGS. 3A-C, 4A-D, and 5A-D are scaled drawings.

DETAILED DESCRIPTION

Reference will now be made in detail to representative embodiments. The following descriptions are not intended to limit the embodiments to one preferred embodiment. To the contrary, it is intended to cover alternatives, modifications, and equivalents as can be included within the spirit and scope of the described embodiments as defined, for example, by the appended claims.

The disclosed devices, systems, and methods of use will be described with reference to FIGS. 1-6. Generally, systems and methods to provide an inflatable paddleboard with an exterior stringer system are provided. The inflatable paddleboard with an exterior stringer system adapts a baseline inflatable paddleboard to an inflatable paddleboard with increased structural strength through fitting the stringer system to the exterior of the inflatable paddleboard.

Although the disclosed devices, systems, and methods of use will be described relative to an inflatable paddleboard for use with recreational water sport activities and the like, the devices, systems, and methods of use have other applications. For example, the inflatable paddleboard with an exterior stringer system may be used to adapt other structures or devices, such as inflatable structures associated with wind surfing and tubing.

Generally, the disclosed inflatable paddleboard with an exterior stringer system maintains the benefits of an inflatable paddleboard while providing increased strength, such as increased rigidity or stiffness.

The term "stiffness" means the extent to which an object resists deformation in response to an applied force.

The term "rigidity" means the inability to be bent or to be forced out of shape.

The term "flexibility" means the quality of bending easily without breaking.

The exterior stringer system is positioned on the bottom surface of an inflatable paddleboard. In one embodiment, the exterior stringer system is formed by a set of longitudinal stringers positioned on opposite sides of the inflatable paddleboard and a set of transverse stringers positioned between the longitudinal stringers. The set of longitudinal stringers and transverse stringers may be arranged in any number of ways, to include in an "IXI" arrangement. These and other embodiments are disclosed in more detail below.

Figure 1:
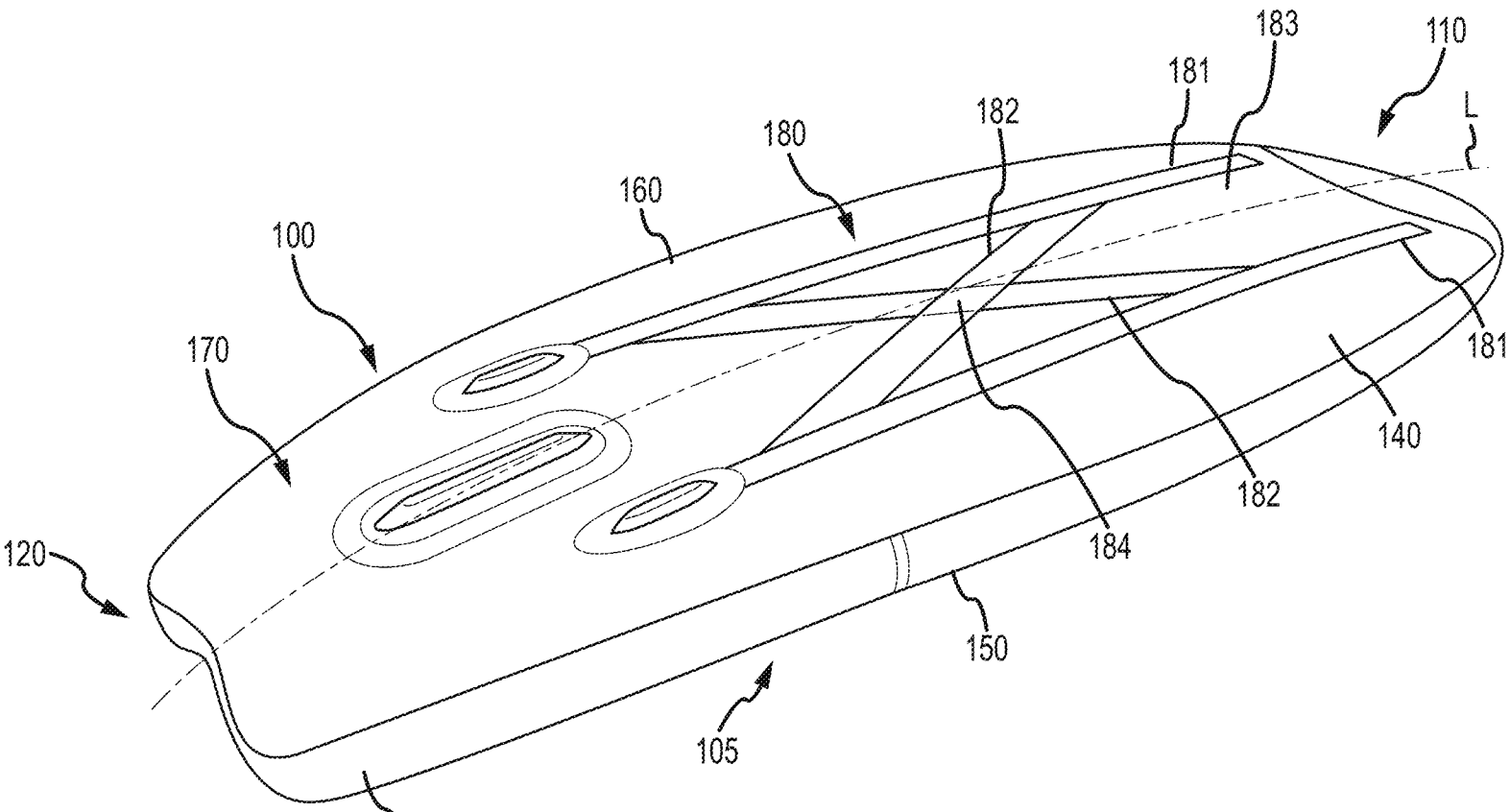
FIG. 1 is a perspective right side bottom view of one embodiment of an exterior stringer system paddleboard.

FIG. 1 provides a right side bottom view of one embodiment of an inflatable paddleboard with exterior stringer system.

The inflatable paddleboard with an exterior stringer system may be referred to as "exterior stringer system paddleboard" or "ESS paddleboard." The exterior stringer system may be referred to as "stringer system" or "ESS."

The exterior stringer system paddleboard 100 includes a body 105, front 110, back 120, left side 150, right side 160, bottom surface 140, top surface opposite bottom surface, thickness 190, fins 170, and exterior stringer system 180 comprising a set of transverse stringers 182 and a set of longitudinal stringers 181. The exterior stringer system 180 is disposed on or attached to the bottom surface 140. The bottom or lower surface 140 resides on or contacts water when the exterior stringer system paddleboard 100 is in use. The top or upper surface 120 supports or contacts a user when the exterior stringer system paddleboard 100 is in use. The term "transverse" means extending in a crosswise direction, e.g., not in a parallel direction.

The exterior stringer system paddleboard 100 has a longitudinal axis L extending between the end of the front 110 (meaning the most distal portion of the front 110) and the end of the back 120 (meaning a most distal portion of the back 120) of the exterior stringer system paddleboard 100. In some embodiments, the exterior stringer system paddleboard 100 is symmetrical about the longitudinal axis L such that the body 105 is divided into equal physical portions. For example, the exterior stringer system 180 may be symmetrical about the longitudinal axis L, such that an intersection area between paired sets of transverse stringers form an intersection positioned at along or coincident with the longitudinal axis.

The set of longitudinal stringers 181 are positioned or disposed generally parallel to the longitudinal axis L and define a bottom surface void 183 therebetween. Stated another way, the area between the set of longitudinal stringers 181 residing on the bottom surface 140 is termed the bottom surface void 183. In the embodiment of FIG. 1, the bottom surface void 183 is between the two longitudinal stringers 181. The set of transverse stringers 182 are positioned or disposed at least partially within or inside the bottom surface void 183. In the embodiment of FIG. 1, the two transverse stringers 182 are positioned or disposed within or inside of the bottom surface void 183, such that a first transverse stringer intersects with a second transverse stringer to form a transverse stringer intersection 184 positioned along or on top of the longitudinal axis L.

In some embodiments, one or both of bottom surface and top surface are generally flat or planar when viewed in cross-section from front 100 or back 120. In some embodiments, one or both of bottom surface and top surface are curved or have a camber, either inwards or outwards. (The term "camber" means to arch or bend slightly, such as to bend or curve in a middle portion.) For example, the top surface may curve from each edge thickness 190 to a point at or near or adjacent the longitudinal axis of greater height or elevation. Stated another way, the top surface may bow upwards in the middle area of the exterior stringer system paddleboard 100. As another example, the lower surface 140 may bow or curve inwards from each edge thickness 190 to a point at or near or adjacent the longitudinal axis of lower or reduced height or elevation. Stated another way, the bottom surface 140 may bow inwards in the middle area of the exterior stringer system paddleboard 100.

Figure 2:
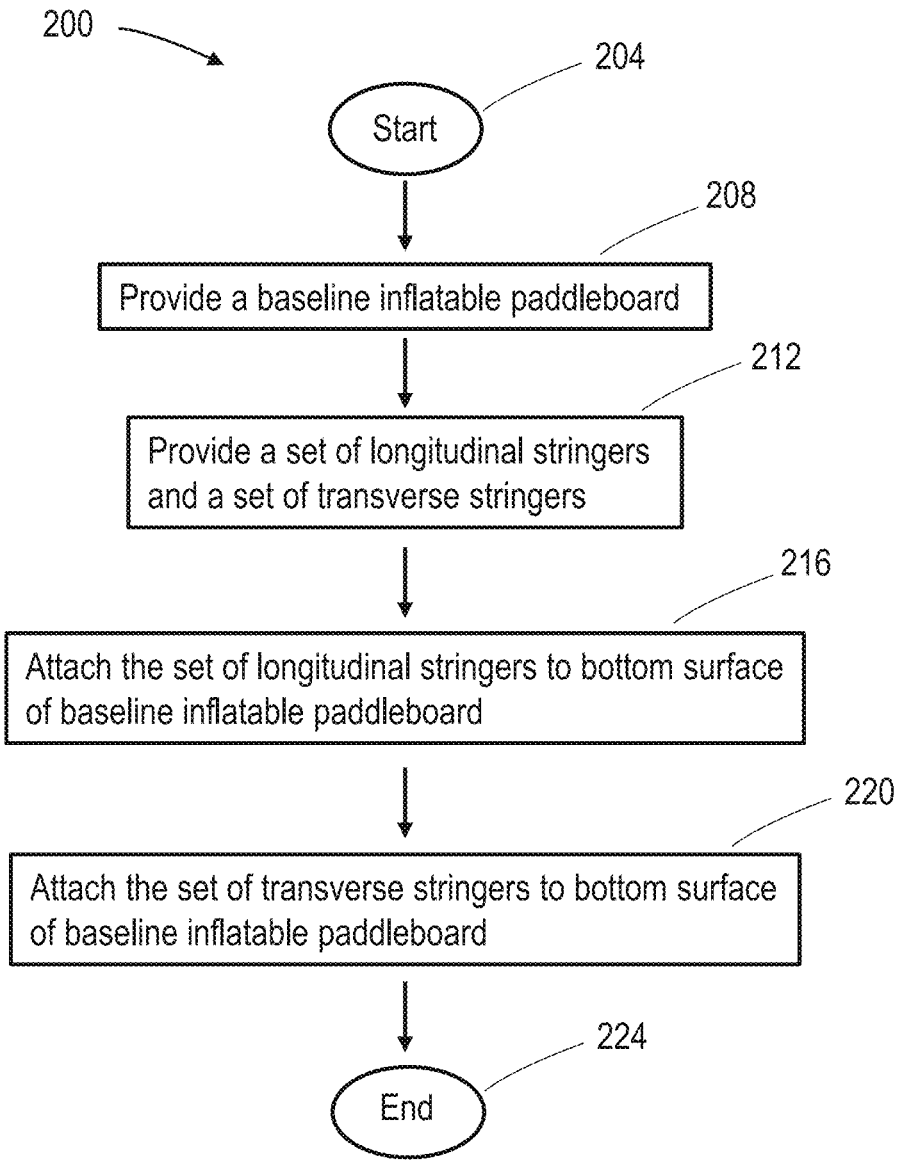
FIG. 2 is a flow chart of one embodiment of a method of assembling an exterior stringer system paddleboard.

FIG. 2 provides a flowchart of one embodiment of a method 200 of assembling of an exterior stringer system paddleboard, such as the exterior stringer system paddleboard 100 of FIG. 1. The method 200 will be described after more examples of embodiments of the disclosed exterior stringer system paddleboard and associated features with respect to FIGS. 3-5 are described.

Figure 3A:
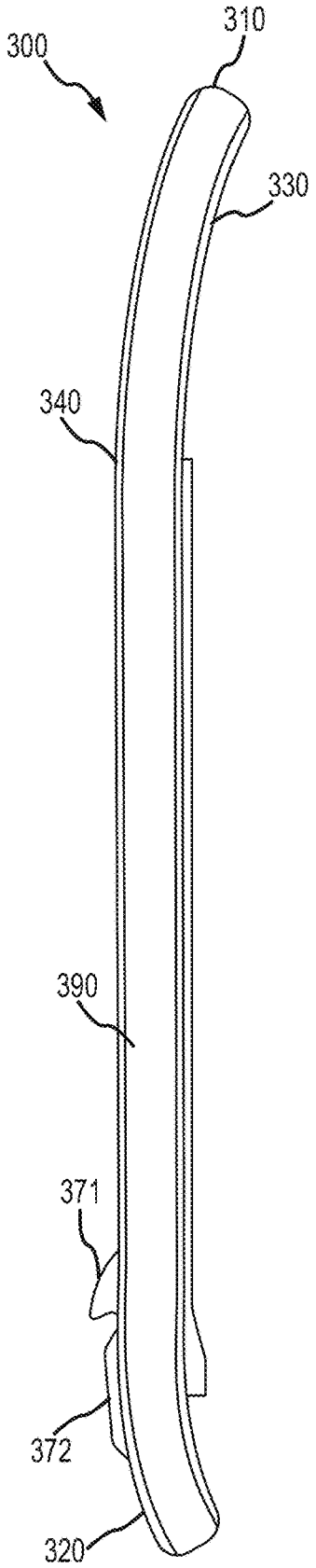
FIG. 3A is a left side view of another embodiment of an exterior stringer system paddleboard.
Figure 3B:
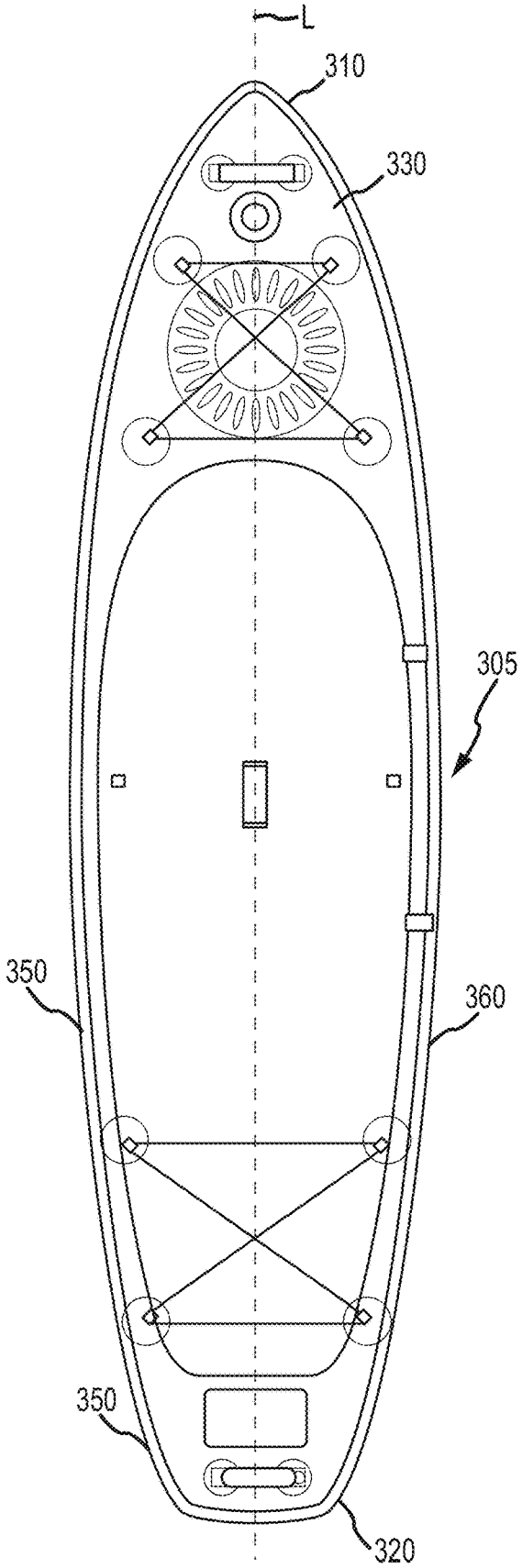
FIG. 3B is a top view of the embodiment of an exterior stringer system paddleboard of FIG. 3A.
Figure 3C:
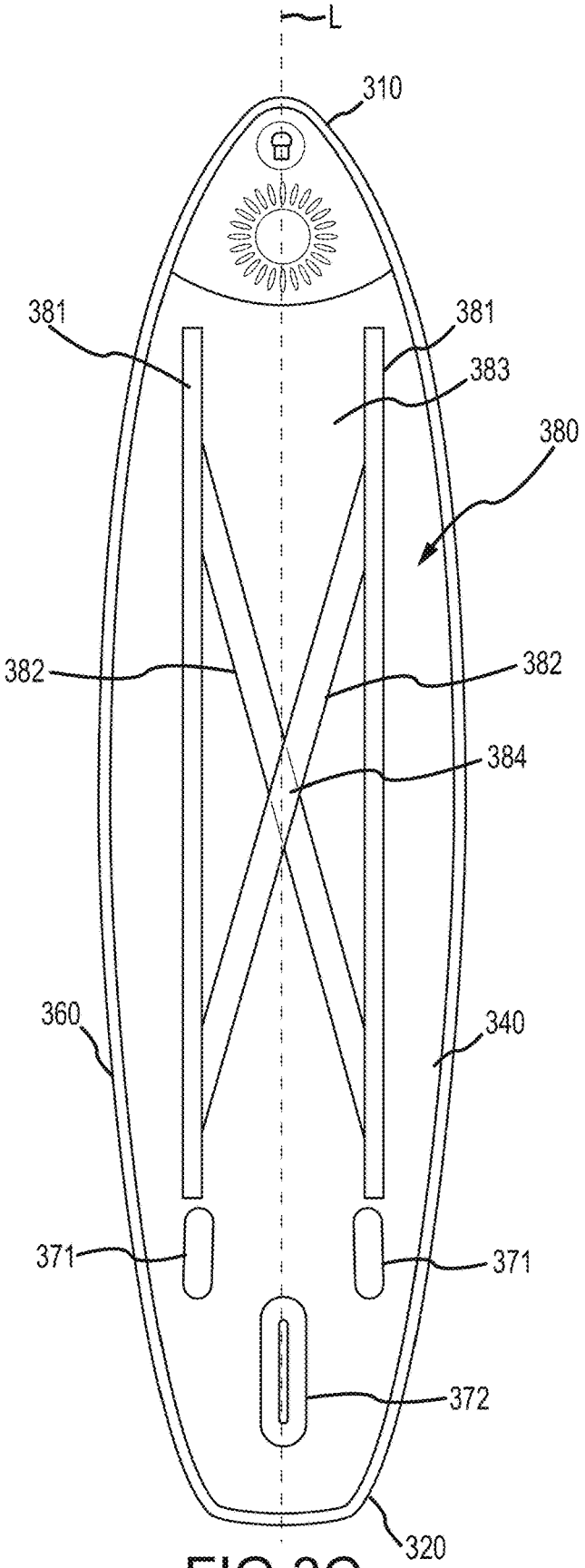
FIG. 3C is a bottom view of the embodiment of an exterior stringer system paddleboard of FIG. 3A.

FIGS. 3A-C provide another embodiment of the exterior stringer system paddleboard 300; the embodiment 300 is similar to that of the embodiment 100 of FIG. 1.

The exterior stringer system paddleboard 300 includes a body 305, front 310, back 320, left side 350, right side 360, bottom surface 340, top surface 330 opposite bottom surface, thickness 390, fins 371 and 372, and exterior stringer system 380 comprising a set of transverse stringers 382 and a set of longitudinal stringers 381. The exterior stringer system 380 is disposed on or attached to the bottom surface 340. The set of fins are of two types: side fin 371 (two in number) and central fin 372 (one in number).

The exterior stringer system paddleboard 300 has a longitudinal axis L extending between the end of the front 310 (meaning the most distal portion of the front 310) and the end of the back 320 (meaning a most distal portion of the back 320) of the exterior stringer system paddleboard 300. In some embodiments, the exterior stringer system paddleboard 300 is symmetrical about the longitudinal axis L such that the body 305 is divided into equal physical portions. For example, the exterior stringer system 380 may be symmetrical about the longitudinal axis L, such that an intersection area between paired sets of transverse stringers form an intersection positioned at along or coincident with the longitudinal axis.

The set of longitudinal stringers 381 are positioned or disposed generally parallel to the longitudinal axis L and define a bottom surface void 383 therebetween. Stated another way, the area between the set of longitudinal stringers 381 residing on the bottom surface 340 is termed the bottom surface void 383. In the embodiment of FIG. 3, the bottom surface void 383 is between the two longitudinal stringers 381. The set of transverse stringers 382 are positioned or disposed at least partially within or inside the bottom surface void 383. In the embodiment of FIG. 3, the two transverse stringers 382 are positioned or disposed within or inside of the bottom surface void 383, such that a first transverse stringer intersects with a second transverse stringer to form a transverse stringer intersection 384 positioned along or on top of the longitudinal axis L.

Each of the two longitudinal stringers 381 may have an equal longitudinal stringer length. The exterior stringer system paddleboard 300 has a paddleboard length, measured from the most distal portion of the front 310 to the most distal portion of the back 320. In a preferred embodiment, the ratio of the longitudinal stringer length to the paddleboard length is about 0.60. In another preferred embodiment, the ratio of the longitudinal stringer length to the paddleboard length is greater than 0.60. In another preferred embodiment, the ratio of the longitudinal stringer length to the paddleboard length is between 0.40 and 0.80. In a more preferred embodiment, the ratio of the longitudinal stringer length to the paddleboard length is between 0.50 and 0.70. In a most preferred embodiment, the ratio of the longitudinal stringer length to the paddleboard length is between 0.55 and 0.65. In one embodiment, the longitudinal stringer lengths are not equal.

The bottom surface void 383 has a void width, as measured between the inner edges of each of the two longitudinal stringers 381. The exterior stringer system paddleboard 300 has a paddleboard maximum width, measured between the two edges of paddleboard at the widest distance between the right side 340 and the left side 360. In a preferred embodiment, the ratio of the void width to the paddleboard maximum width is about 0.5. In another preferred embodiment, the ratio of the void width to the paddleboard maximum width is greater than 0.5. In another preferred embodiment, the ratio of the void width to the paddleboard maximum width is less than 0.5. In another preferred embodiment, the ratio of the void width to the paddleboard maximum width is between 0.35 and 0.65. In a more preferred embodiment, the ratio of the void width to the paddleboard maximum width is between 0.40 and 0.60. In a most preferred embodiment, the ratio of the void width to the paddleboard maximum width is between 0.45 and 0.65.

Figure 4A:
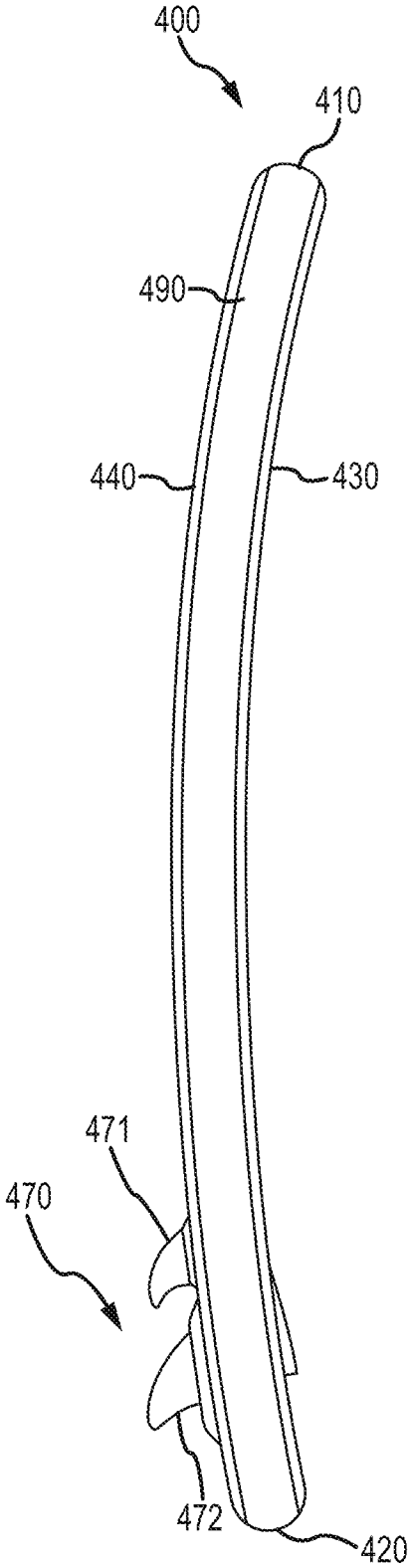
FIG. 4A is a left side view of yet another embodiment of an exterior stringer system paddleboard.
Figure 4B:
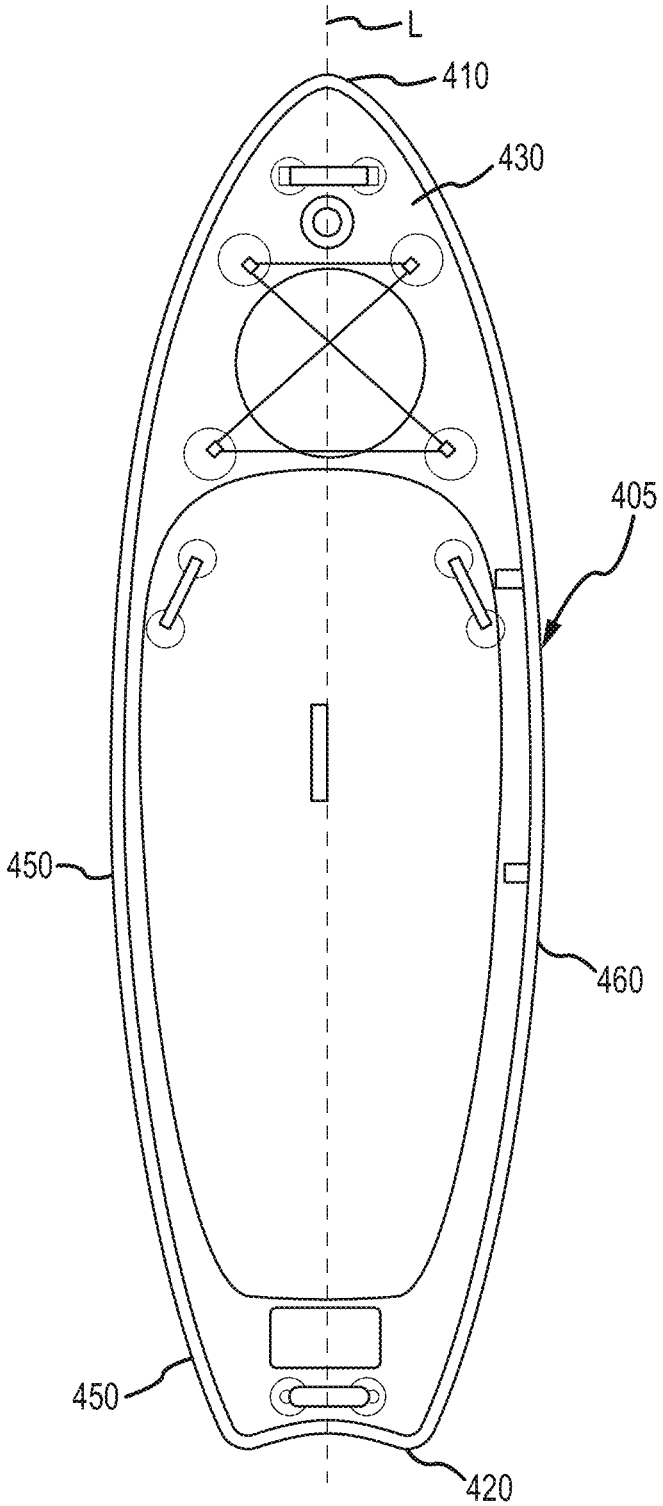
FIG. 4B is a top view of the embodiment of exterior stringer system paddleboard of FIG. 3A.
Figure 4C:
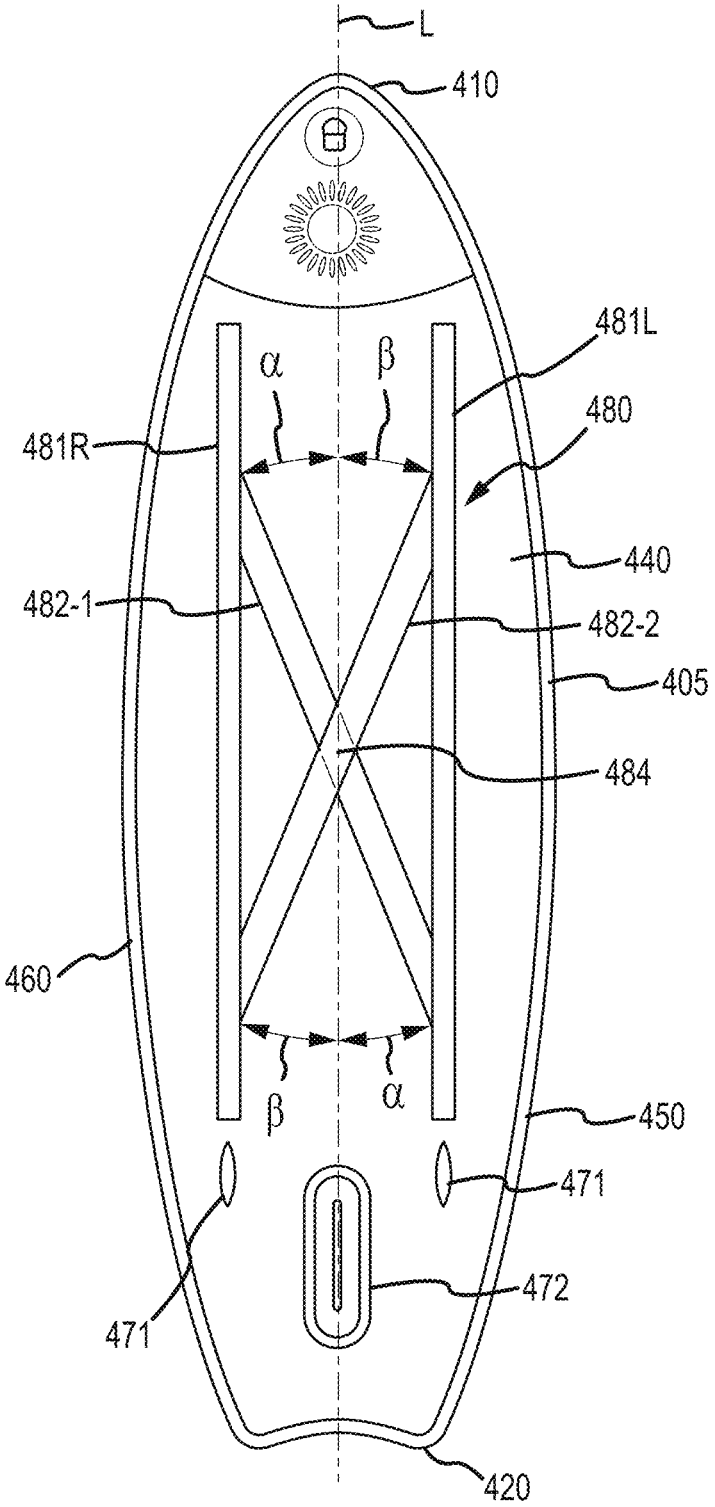
FIG. 4C is a bottom view of the embodiment of an exterior stringer system paddleboard of FIG. 4A.

FIGS. 4A-C provide another embodiment of the exterior stringer system paddleboard 400. The embodiment 400 is similar to that of the embodiment 100 of FIG. 1 and the embodiment 300 of FIGS. 3A-C. In comparing the exterior stringer system paddleboard 300 with exterior stringer system paddleboard 400, the dimensions of the body 440 are different than those of the body 340 (e.g. body 440 is shorter and wider than body 340) and the corresponding dimensions of the exterior stringer system 480 are different than those of the exterior stringer system 380 (e.g. exterior stringer system 480 is slightly shorter and wider than that of exterior stringer system 380). The exterior stringer system paddleboard 400 includes a body 405, front 410, back 420, left side 450, right side 460, bottom surface 440, top surface 430 opposite bottom surface, thickness 490, a collective set of fins 470 comprising side fins 471 and central fin 472, and exterior stringer system 480 comprising a set of transverse stringers 482-1 and 482-2 and a set of longitudinal stringers 481R and 481L. The exterior stringer system 480 is disposed on or attached to the bottom surface 440.

The exterior stringer system paddleboard 400 has a longitudinal axis L extending between the end of the front 410 (meaning the most distal portion of the front 410) and the end of the back 420 (meaning a most distal portion of the back 420) of the exterior stringer system paddleboard 400. In some embodiments, the exterior stringer system paddleboard 400 is symmetrical about the longitudinal axis L such that the body 405 is divided into equal physical portions. For example, the exterior stringer system 480 may be symmetrical about the longitudinal axis L, such that an intersection area between paired sets of transverse stringers form an intersection positioned at along or coincident with the longitudinal axis.

The set of longitudinal stringers 481R and 481L are positioned or disposed generally parallel to the longitudinal axis L and define a bottom surface void 483 therebetween. Stated another way, the area between the set of longitudinal stringers 481R and 481L residing on the bottom surface 440 is termed the bottom surface void 483. In the embodiment of FIGS. 4A-C, the bottom surface void 483 is between the two longitudinal stringers 481R and 481L.

Each of right longitudinal stringer 481R and a left longitudinal stringer 481L are positioned generally parallel to the longitudinal axis L, and each is positioned between the longitudinal axis L and a respective edge of the body 405. Each of right longitudinal stringer 481R and left longitudinal stringer 481L have a thickness or width less than a respective length and form a straight line (i.e., they form a rectangle). Each of right longitudinal stringer 481R and left longitudinal stringer 481L begin just beyond (relative to the front 410) of the set of two lateral fins 471 and end at a length below (relative to the front 410) of the tip of the body 405. Other configurations of longitudinal stringers are possible, e.g., varied in number (two longitudinal stringers are shown in FIGS. 1, 3C, 4C, 5A, and 5B, in contrast to three longitudinal stringers in FIG. 5C), may be of other than a straight line (e.g., may form an arc that conforms or reflects the outer curved dimension of the body 405), etc. The set of longitudinal stringers may be of common dimension and shape or may be of varied dimension and/or shape. For example, in the embodiment of FIG. 5C, the central or center longitudinal stronger may extend longer than the remaining two outer longitudinal stringers or may be of wider width.

The set of transverse stringers 482-1 and 482-2 are positioned or disposed at least partially within or inside the bottom surface void 483. In the embodiment of FIGS. 4A-C, the two transverse stringers 482-1 and 482-2 are positioned or disposed within or inside of the bottom surface void 483, such that a first transverse stringer 482-1 intersects with a second transverse stringer 482-2 to form a transverse stringer intersection 484 positioned along or on top of the longitudinal axis L.

Each of first transverse stringer 482-1 and second transverse stringer 482-2 are positioned at an angle with respect to the longitudinal axis L. Stated another way, each of first transverse stringer 482-1 and second transverse stringer 482-2 are positioned other than parallel to the longitudinal axis L. Each of first transverse stringer 482-1 and second transverse stringer 482-1 are positioned between a region of the bottom surface 440 bounded by the right longitudinal stringer 481R and the left longitudinal stringer 481L. Each of the first transverse stringer 482-1 and second transverse stringer 482-2 begin and end at each of the right longitudinal stringer 481R and the left longitudinal stringer 481L.

The first transverse stringer 482-1 and the second transverse stringer 482-2 may be of similar or equal width to one another or may be of different width. The first transverse stringer 482-1 and the second transverse stringer 482-1 may be of varied width along a length, such as a first width and a second width. The first transverse stringer 482-1 and/or the second transverse stringer 482-2 may be of similar or equal width to one or both of the right longitudinal stringer 481R and the left longitudinal stringer 481L. The first transverse stringer 482-1 and the second transverse stringer 482-1 may be of wider or narrower width to one or both of the right longitudinal stringer 481R and the left longitudinal stringer 481L. The set of transverse stringers may be of common dimension and shape or may be of varied dimension and/or shape.

Figure 5A:
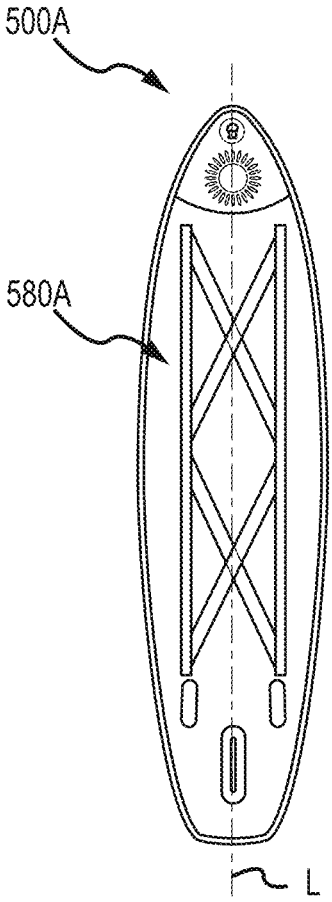
FIG. 5A is a bottom view of yet another embodiment of an exterior stringer system paddleboard.
Figure 5B:
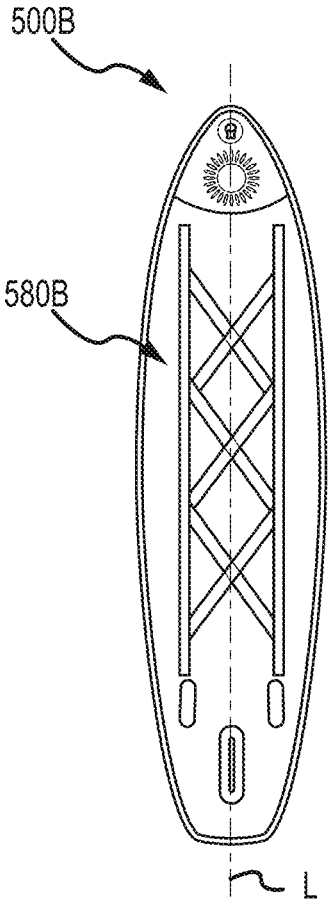
FIG. 5B is a bottom view of yet another embodiment of an exterior stringer system paddleboard.
Figure 5C:
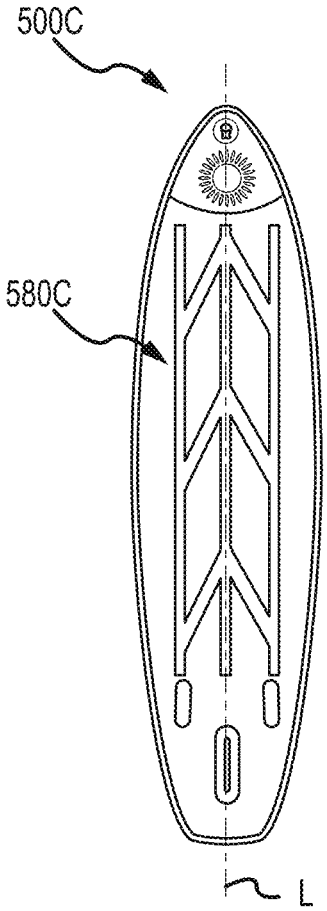
FIG. 5C is a bottom view of yet another embodiment of an exterior stringer system paddleboard.

The set of longitudinal stringers and transverse stringers (collectively, the "set of external stringers") may form various patterns on the bottom surface 440 of the body 405 of the inflatable paddleboard with exterior stringer system. In the embodiments of FIGS. 1, 3C, 4C, 5A, and 5B the set of external stringers form an "IXI" pattern, in which the "I" portions extend beyond the upper and lower "X" portions. Other configurations of the set of external stringers are possible. For example, FIG. 5A depicts an exterior stringer system 580A forming a double IXI pattern in which a set of two IXI patterns are stacked in series. FIG. 5B depicts an exterior stringer system 580B forming a triple IXI stacked configuration of a set of external stringers. FIG. 5C depicts an exterior stringer system 580C forming an inverted "IVI" configuration with a central third longitudinal stringer. (See below description of FIGS. 5A-C).

One or more of the longitudinal stringers and transverse stringers may of a material that provides increased strength to the body 405 and/or bottom surface 440 of an inflatable paddleboard. For example, each of the longitudinal stringers and transverse stringers may be made of a standard polyvinyl chloride ("PVC") material, a PVC that contains carbon, and/or a directional PVC. In one embodiment, one or more of the sets of external stringers are made of a composite material such as a carbon fiber material. The term "carbon-fiber" or "carbon fiber" means fibers made mostly of carbon.

One or more of the sets of external stringers may be applied to or disposed on or attached to the bottom surface 440 may any of several means known to those skilled in the art, to include by adhesives such as glue, and heat applications such as vulcanization.

The set of external stringers provide a number of benefits. For example, the set of external stringers increases the structural integrity of the body 405 of an inflatable paddleboard, such as increasing one or more of the longitudinal and/or lateral strength (aka less flexing and more stiff or rigid) and increasing the torsional strength (aka less twisting). The set of external stringers transfer and/or distribute the weight or force applied to the paddleboard (e.g., by the weight of a user) more extensively and/or evenly than a conventional paddleboard devoid of such a set of external stringers. The set of external stringers work in concert with one another to transfer and/or distribute forces applied (e.g., a weight) to the body 405.

In one embodiment, one or more of the sets of longitudinal stringers are positioned with an arc or curve that approximately matches the arc or curve off the paddleboard body 440. For example, the longitudinal stringer 481L on the left side 450 of the body 440 (note that because FIG. 4C is a view of the bottom of the paddleboard body 440, the right side of the figure is the left side of the paddleboard when viewed from the paddleboard upper or top surface) may curve outward to match or mirror the exterior or outer curve of the left side 450 edge of the body 440. Similarly, the longitudinal stringer 481R on the right side of the body 440 may curve outward to match or mirror the exterior or outer curve of the right side 460 edge of the body 440.

The set of longitudinal stringers 481R and 481L may be symmetrically disposed or positioned (symmetrical relative to the longitudinal axis L) on the bottom surface 440. The set of longitudinal stringers 481R and 481L may be disposed or positioned in front of (meaning more toward the front 410) of the side fins 471.

The set of transverse stringers 482-1 and 482-2 may be symmetrically disposed or positioned (symmetrical relative to the longitudinal axis L) on the bottom surface 440. The set of transverse stringers 482-1 and 482-2 may be disposed or positioned in front of (meaning more toward the front 410) of the side fins 471.

The set of transverse stringers 482-1 and 482-2 are positioned or disposed on the bottom surface 440 at an angle with respect to the longitudinal axis L and with respect to the set of longitudinal stringers 481L and 482R. More specifically, transverse stringer 482-1 forms a first angle $\alpha$ with the longitudinal axis L, and transverse stringer 482-2 forms a second angle $\beta$ with the longitudinal axis L. (Note symmetry in each of first angle $\alpha$ and second angle $\beta$ on as respective transverse stringer 482-1 and 482-2 insect at intersection point 484 and switch sides of paddleboard).

In one embodiment, first angle $\alpha$ and second angle $\beta$ are substantially equal or are equal. In one embodiment, one or both of first angle $\alpha$ and second angle $\beta$ are approximately 24 degrees. In a preferred embodiment, one or both of first angle $\alpha$ and second angle $\beta$ are between 20 and 28 degrees. In a more preferred embodiment, one or both of first angle $\alpha$ and second angle $\beta$ are between 22 and 26 degrees.

In one preferred embodiment, one or both of first angle $\alpha$ and second angle $\beta$ are approximately 17 degrees. In a preferred embodiment, one or both of first angle $\alpha$ and second angle $\beta$ are between 12 and 21 degrees. In a more preferred embodiment, one or both of first angle $\alpha$ and second angle $\beta$ are between 14 and 19 degrees. FIGS. 5A-C provide a set of three further embodiments of the disclosed exterior stringer system paddleboard with alternate configurations of exterior stringer systems. The respective embodiments of an exterior stringer system paddleboard 500A, 500B, and 500C of FIGS. 5A-C are generally similar to that of the embodiment 100 of FIG. 1 except with varied respective exterior stringer system configurations 580A, 580B, and 580C.

Figure 4D:
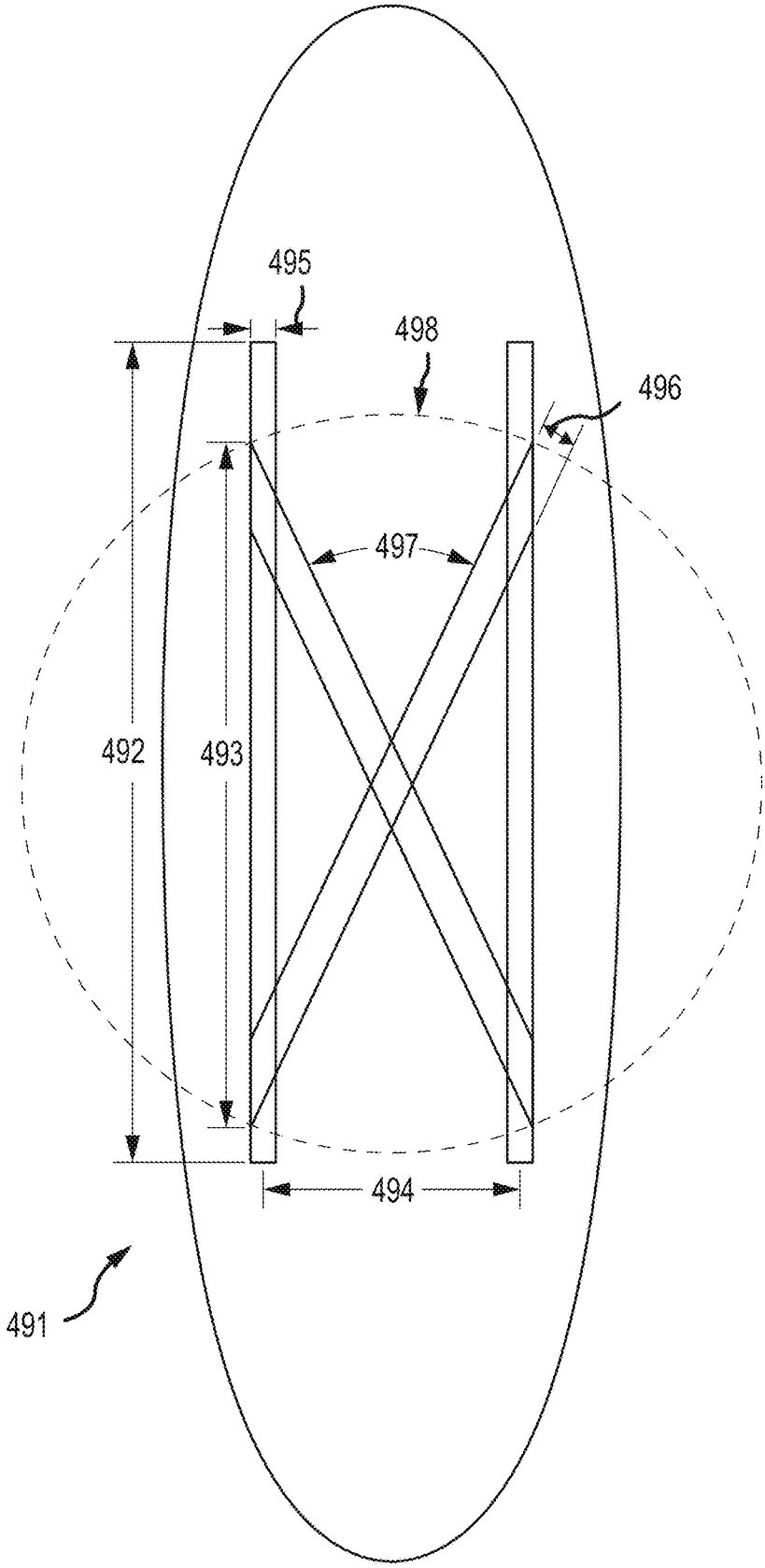
FIG. 4D is a bottom view of another embodiment of an exterior stringer system paddleboard describing geometries of the exterior stringer system.

FIG. 4D is a bottom view of another embodiment of an exterior stringer system paddleboard describing geometries of the exterior stringer system. FIG. 4E is a table of nominal values for the identified components of several designs of the exterior stringer system of FIG. 4D.

The exterior stringer system paddleboard 491 of FIG. 4D has a set of two of longitudinal stringers of length 492 separated by a width 494, each longitudinal stringer of width 495, and a set of two transverse stringers which intersect each of the two longitudinal stringers to define a length 493. The set of two transverse stringers form an angle 497 and have a width 496. The upper intersection points of the edges of the set of two transverse stringers with the set of two longitudinal stringers define a diameter 498.

FIG. 4E describes a table 499 of six designs of the exterior stringer system paddleboard 491 of FIG. 4D. A set of six designs are presented in the set of seven rows. In each row, values or dimensions of a particular design are provided, specifically values for elements 492, 493, 494, 495, 498, and 497 as defined in FIG. 4D. For example, design "SOL Train" has a set of two longitudinal stringers of length 492 value of 1700 mm, each with a width 495 value of 50 mm, a set of two transverse stringers which intersect each of the two longitudinal stringers to define a length 493 of value 1138 mm and form an angle 497 of value 41 degrees, and the upper intersection points of the edges of the set of two transverse stringers with the set of two longitudinal stringers define a diameter 498 of value 1346 mm.

Each of the values of the set of designs of FIG. 4E may differ slightly, meaning within 5% of the presented value and/or within 5 mm or within 10 mm of the set of values for a particular design of FIG. 4E. In some embodiments, each of the values of the set of designs of FIG. 4E may differ within 10% of the presented value and/or within 10 mm or within 20 mm.

In some embodiments of configurations of any of the designs of FIG. 4D, the value of the width of the transverse stringers is about the same as the width of the longitudinal stringers.

In some embodiments of configurations of any of the designs of FIG. 4D, the value of the width of the transverse stringers is wider than the width of the longitudinal stringers. In some embodiments of configurations of any of the designs of FIG. 4D, the value of the width of the transverse stringers is narrower than the width of the longitudinal stringers. In some embodiments of configurations of any of the designs of FIG. 4D, the value of the width of the transverse stringers is any of 2 in, 3 in, 4 in, 6 in, and 8 in. In some embodiments of configurations of any of the designs of FIG. 4D, the value of the width of the longitudinal stringers is any of 2 in, 3 in, 4 in, 6 in, and 8 in.

The embodiment of an exterior stringer system paddleboard 500A of FIG. 5A includes an exterior stringer system 580A comprising a repeating set of two "IXI" configurations of lateral and transverse stringers. Each of the set of two "IXI" stringer configurations are identical. In other embodiments of the exterior stringer system paddleboard 500A, the set of two "IXI" stringer configurations are not identical.

The embodiment of an exterior stringer system paddleboard 500B of FIG. 5B includes an exterior stringer system 580B comprising a repeating set of three "IXI" configurations of lateral and transverse stringers. Each of the set of three "IXI" stringer configurations are identical. In other embodiments of the exterior stringer system paddleboard 500B, the set of three "IXI" stringer configurations are not identical, or two of the three are identical.

The embodiment of an exterior stringer system paddleboard 500C of FIG. 5C includes an exterior stringer system 580C comprising a repeating set of three inverted "V" configurations of transverse stringers with a pair of adjacent lateral stringers. The exterior stringer system paddleboard 500C also comprises a central third longitudinal stringer positioned along the longitudinal axis L. Note the tip of the inverted "V" is pointed toward the front of the paddleboard. Each of the set of three inverted "V" stringer configurations are identical. In other embodiments of the exterior stringer system paddleboard 500C, the set of three inverted "V" stringer configurations are not identical, or two of the three are identical. In one embodiment, the inverted "V" is not inverted, such that the tip of the "V" is pointed toward the bottom of the paddleboard.

Other configurations of lateral and transverse stringers are possible to include combinations of the embodiments described above. For example, a pattern, from front of the paddleboard body to bottom, an inverted "V" then an "X" and then a "V", all with a length of adjacent lateral stringers.

FIG. 2 is a flow chart of one method of assembly of an exterior stringer system paddleboard of the type described in FIGS. 1 and 3-5. In one embodiment of a method of assembly, the exterior stringer system paddleboard may be assembled in the sequence of steps described in FIG. 2. Other methods of assembly are possible, to include a sequence of steps different than those of FIG. 2, a sequence with additional steps, and a sequence with fewer steps. For example, in one embodiment, the exterior stringer system is provided as a preassembled unit comprising a set of horizontal stringers and transverse stringers already connected.

With particular attention to FIG. 2, a flowchart of a method of assembly of an exterior stringer system paddleboard is provided, the method 200 utilizing the elements described in the systems of FIG. 1 and/or FIGS. 3-5. Reference may be made to FIGS. 1 and 3-5 and to the descriptions of FIG. 1 and FIGS. 3-5. The method 200 of FIG. 2 may be applied to other embodiments of the convertible protective screen system than those of FIG. 1 and FIGS. 3-5.

The method 200 starts at step 204 and ends at step 224. The steps are notionally followed in increasing numerical sequence, although, in some embodiments, some steps may be omitted, some steps added, and the steps may follow other than increasing numerical order.

At step 208, a baseline inflatable paddleboard is provided. The baseline paddleboard is inflated so as to enable the attachment of a set of external stringers to the bottom of the body of the paddleboard. At the completion of step 208, the method 200 continues to step 212.

At step 212, a set of longitudinal stringers and a set of transverse stringers are provided. One or more of the longitudinal stringers and the transverse stringers may be precut and/or affixed with an adhesive for ready attachment to the paddleboard. The adhesive may be any adhesive known to those skilled in the art, to include commercially-available glues. In one embodiment, the set of longitudinal stringers and a set of transverse stringers are provided in a predetermined configuration, such as the IXI configuration discussed above. At the completion of step 212, the method 200 continues to step 216.

At step 216, the set of longitudinal stringers are attached to the bottom surface of the baseline paddleboard, as described above. At the completion of step 216, the method 200 continues to step 220.

At step 220, the set of transverse stringers are attached to the bottom surface of the baseline paddleboard, as described above. At the completion of step 220, the method 200 ends.

Figure 6:
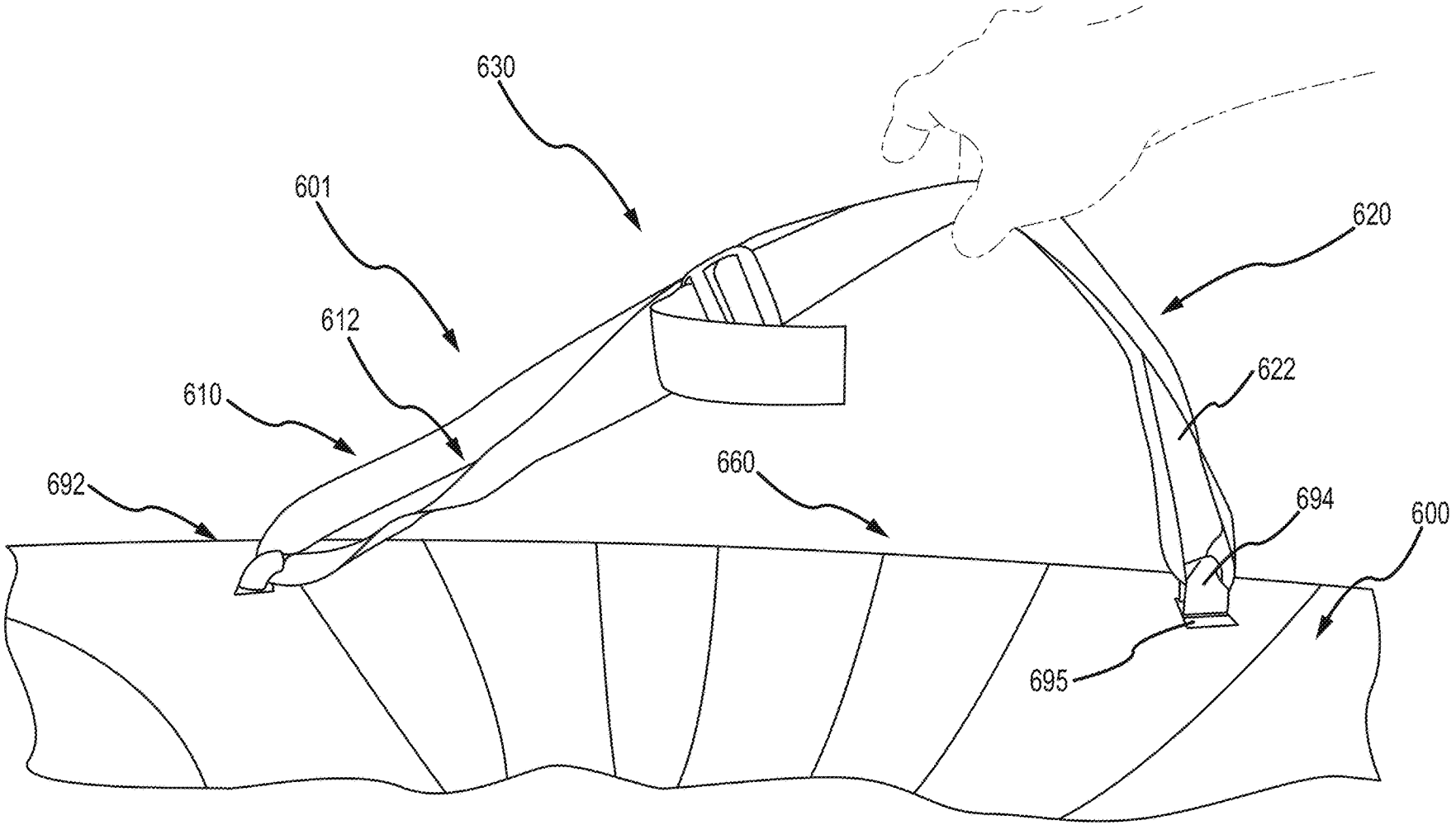
FIG. 6 is a perspective view of one embodiment of a combined carry and roll strap for use with an exterior stringer system paddleboard.

FIG. 6 depicts one embodiment of a combined carry and roll strap 601 for use with an exterior stringer system paddleboard 600, to include the exterior stringer system paddleboard embodiments of FIGS. 1 and 3-5. The combined carry and roll strap 601 is configured to both carry an inflated paddleboard 600 and to carry a rolled-up paddleboard 600, such as the exterior stringer system paddleboards of FIG. 1 and FIGS. 3-5. The combined carry and roll strap 601 may also be adapted to carry other inflatable devices, such as an inflatable sled. The combined carry and roll strap 601, or simply the "strap," has a first end 610, a second end 620, and a buckle 630. The first end 610 forms a first void 612 and the second end 620 forms a second void 622. The first end 610 loops within or around a first eyelet 692 (of the inflatable paddleboard 600) and the second end 620 loops within or around a second eyelet 694 of the inflatable paddleboard 600.

Each of first eyelet 692 and second eyelet 694 are secured to the board by any of several means, such as one or more anchors 695 and/or embedded within the thickness of the board. Each of first eyelet 692 and second eyelet 694 are disposed or positioned on or near or adjacent an edge of the upper surface of the inflatable paddleboard 600, on the right side or the left side of the paddleboard. In one embodiment, each of first eyelet 692 and second eyelet 694 are positioned or disposed on an edge of the bottom side of the inflatable paddleboard 600, on the left side or the right side of the paddleboard. The one or more anchors 695 may be positioned within a well or cavity of the board 600.

The strap 601 may be used to carry the inflatable paddleboard 600 when the inflatable paddleboard 600 is in an inflated state (i.e., a shoulder carry strap mode), and/or may be used to carry the inflatable paddleboard 600 when the inflatable paddleboard 600 is in a deflated state, e.g., when the inflatable paddleboard 600 is rolled up. In one embodiment, the strap 601 has more than one buckle 630, e.g., has two buckles 630. In one embodiment, the strap 601 includes a label that defines how it may be used, e.g., "Put Strap Through the 2 loops [eyelets 692, 694] on the Right Side of the Board for Easy Carrying."

The exemplary systems and methods of this disclosure have been described in relation to systems and methods involving an inflatable paddleboard with exterior stringer system. However, to avoid unnecessarily obscuring the present disclosure, the preceding description omits a number of known structures and devices, and other application and embodiments. This omission is not to be construed as a limitation of the scopes of the claims. Specific details are set forth to provide an understanding of the present disclosure. It should however be appreciated that the present disclosure may be practiced in a variety of ways beyond the specific detail set forth herein.

A number of variations and modifications of the disclosure can be used. It would be possible to provide for some features of the disclosure without providing others.

Although the present disclosure describes components and functions implemented in the aspects, embodiments, and/or configurations with reference to particular standards and protocols, the aspects, embodiments, and/or configurations are not limited to such standards and protocols. Other similar standards and protocols not mentioned herein are in existence and are considered to be included in the present disclosure. Moreover, the standards and protocols mentioned herein, and other similar standards and protocols not mentioned herein are periodically superseded by faster or more effective equivalents having essentially the same functions. Such replacement standards and protocols having the same functions are considered equivalents included in the present disclosure.

The present disclosure, in various aspects, embodiments, and/or configurations, includes components, methods, processes, systems and/or apparatus substantially as depicted and described herein, including various aspects, embodiments, configurations embodiments, sub-combinations, and/or subsets thereof. Those of skill in the art will understand how to make and use the disclosed aspects, embodiments, and/or configurations after understanding the present disclosure. The present disclosure, in various aspects, embodiments, and/or configurations, includes providing devices and processes in the absence of items not depicted and/or described herein or in various aspects, embodiments, and/or configurations hereof, including in the absence of such items as may have been used in previous devices or processes, e.g., for improving performance, achieving ease and\or reducing cost of implementation.

The foregoing discussion has been presented for purposes of illustration and description. The foregoing is not intended to limit the disclosure to the form or forms disclosed herein. In the foregoing Detailed Description for example, various features of the disclosure are grouped together in one or more aspects, embodiments, and/or configurations for the purpose of streamlining the disclosure. The features of the aspects, embodiments, and/or configurations of the disclosure may be combined in alternate aspects, embodiments, and/or configurations other than those discussed above. This method of disclosure is not to be interpreted as reflecting an intention that the claims require more features than are expressly recited in each claim. Rather, as the following claims reflect, inventive aspects lie in less than all features of a single foregoing disclosed aspect, embodiment, and/or configuration. Thus, the following claims are hereby incorporated into this Detailed Description, with each claim standing on its own as a separate preferred embodiment of the disclosure.

Moreover, though the description has included description of one or more aspects, embodiments, and/or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and/or configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. An exterior stringer system paddleboard comprising:

an inflatable paddleboard comprising a body, a front, a back, a top surface, a bottom surface with a bottom surface left side and a bottom surface right side, and a longitudinal axis extending between the front and the back; and an exterior stringer system disposed on the bottom surface, the exterior stringer system comprising a set of longitudinal stringers and a set of transverse stringers; wherein:

the set of longitudinal stringers are positioned generally parallel to the longitudinal axis and define a bottom surface void therebetween; and the set of transverse stringers are positioned at least partially within the bottom surface void and at one or more angles from the longitudinal axis.

2. The exterior stringer system paddleboard of claim 1, wherein the set of transverse stringers form a symmetrical X shape between at least two longitudinal stringers of the set of longitudinal stringers, the at least two longitudinal stringers positioned adjacent each of the bottom surface left side and the bottom surface right side.

3. The exterior stringer system paddleboard of claim 1, wherein:

the set of longitudinal stringers are at least two longitudinal stringers comprising a first longitudinal stringer and a second longitudinal stringer;

the set of transverse stringers are at least two transverse stringers comprising a first transverse stringer and a second transverse stringer;

the first transverse stringer extends from the first longitudinal stringer to the second longitudinal stringer; and the second transverse stringer extends from the second longitudinal stringer to the first longitudinal stringer.

4. The exterior stringer system paddleboard of claim 3, wherein the first transverse stringer intersects with the second transverse stringer to form a transverse stringer intersection.

5. The exterior stringer system paddleboard of claim 4, wherein the transverse stringer intersection is positioned along the longitudinal axis.

6. The exterior stringer system paddleboard of claim 5, wherein the at least two transverse stringers and the at least two longitudinal stringers define a symmetrical shape about the longitudinal axis.

7. The exterior stringer system paddleboard of claim 1, wherein the exterior stringer system provides an increased strength of the inflatable paddleboard along the longitudinal axis.

8. The exterior stringer system paddleboard of claim 7, wherein the exterior stringer system provides an increased strength of the inflatable paddleboard along a lateral axis of the inflatable paddleboard, the lateral axis perpendicular to the longitudinal axis.

9. The exterior stringer system paddleboard of claim 1, wherein a length of each of the at least two longitudinal stringers is at least 60% of an inflatable paddleboard length defined as a distance between the front and the back.

10. The exterior stringer system paddleboard of claim 9, wherein the at least two longitudinal stringers and the at least two transverse stringers are made of a PVC material.

11. The exterior stringer system paddleboard of claim 10, wherein the PVC material comprises carbon.

12. An exterior stringer system paddleboard comprising:

an inflatable paddleboard comprising a body, a front, a back, a top surface, a bottom surface with a bottom surface left side and a bottom surface right side, and a longitudinal axis extending between the front and the back; and an exterior stringer system disposed on the bottom surface, the exterior stringer system comprising two longitudinal stringers and at least two transverse stringers; wherein:

the two longitudinal stringers are positioned generally parallel to the longitudinal axis and define a bottom surface void therebetween; and the at least two transverse stringers are positioned between the bottom surface void and at an acute angle with respect to the longitudinal axis, each of the at least two transverse stringers forming a connection with each of the two longitudinal stringers; wherein:

the exterior stringer system increases the stiffness of the inflatable paddleboard.

13. The exterior stringer system paddleboard of claim 12, wherein:

the two longitudinal stringers and the at least two transverse stringers comprise a PVC material;

a length of each of the at two longitudinal stringers is at least 60% of an inflatable paddleboard length defined as a distance between the front and the back; and a first transverse stringer intersects with a second transverse stringer to form a transverse stringer intersection, the transverse stringer intersection positioned along the longitudinal axis.

14. A method of assembling an exterior stringer system paddleboard comprising:

providing an inflatable paddleboard comprising a body, a front, a back, a top surface, a bottom surface with a bottom surface left side and a bottom surface right side, and a longitudinal axis extending between the front and the back;

providing a set of longitudinal stringers and a set of transverse stringers;

attaching the set of longitudinal stringers to the bottom surface, the set of longitudinal stringers positioned generally parallel to the longitudinal axis and defining a bottom surface void therebetween; and attaching the set of transverse stringers to the bottom surface at least partially within the bottom surface void, the set of transverse stringers positioned at one or more angles from the longitudinal axis; wherein:

an exterior stringer system paddleboard is assembled.

15. The method of claim 14, wherein:

each of the set of longitudinal stringers and the set of transverse stringers are attached to the bottom surface using an adhesive.

16. The method of claim 14, wherein:

the set of transverse stringers form a symmetrical X shape between at least two longitudinal stringers of the set of longitudinal stringers, the at least two longitudinal stringers positioned adjacent each of the bottom surface left side and the bottom surface right side.

17. The method of claim 14, wherein:

the set of longitudinal stringers are at least two longitudinal stringers comprising a first longitudinal stringer and a second longitudinal stringer;

the set of transverse stringers are at least two transverse stringers comprising a first transverse stringer and a second transverse stringer;

the first transverse stringer extends from the first longitudinal stringer to the second longitudinal stringer; and the second transverse stringer extends from the second longitudinal stringer to the first longitudinal stringer.

18. The method of claim 14 wherein the first transverse stringer intersects with the second transverse stringer to form a transverse stringer intersection positioned along the longitudinal axis.

19. The method of claim 14, wherein the exterior stringer system provides an increased strength of the inflatable paddleboard along the longitudinal axis.

20. The method of claim 14, wherein a length of each of the at least two longitudinal stringers is at least 60% of an inflatable paddleboard length defined as a distance between the front and the back.

* * * * *